US009275584B2

(12) United States Patent
Wang et al.

(10) Patent No.: US 9,275,584 B2
(45) Date of Patent: Mar. 1, 2016

(54) BRIGHTNESS CONTROL APPARATUS AND BRIGHTNESS CONTROL METHOD

(71) Applicant: GETAC TECHNOLOGY CORPORATION, Hsinchu County (TW)

(72) Inventors: Chun-Chi Wang, New Taipei (TW); Yo-Ching Wu, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 94 days.

(21) Appl. No.: 14/158,648

(22) Filed: Jan. 17, 2014

(65) Prior Publication Data

US 2015/0206481 A1 Jul. 23, 2015

(51) Int. Cl.
*G09G 3/34* (2006.01)

(52) U.S. Cl.
CPC ..... *G09G 3/3406* (2013.01); *G09G 2320/041* (2013.01); *G09G 2320/064* (2013.01); *G09G 2320/0626* (2013.01); *G09G 2380/00* (2013.01)

(58) Field of Classification Search
CPC ..... G09G 3/3406; G09G 2380/00; G09G 2320/064; G09G 2320/041; G09G 2320/0626
See application file for complete search history.

(56) References Cited

U.S. PATENT DOCUMENTS 8,994,277 B2 * 3/2015 Yang ..... H05B 33/0818 315/185 R
2004/0183821 A1 * 9/2004 Woo ..... G09G 3/3406 345/691
2005/0093958 A1 * 5/2005 Mori et al. ..... 347/207
2006/0279521 A1 12/2006 Lin
2007/0146300 A1 * 6/2007 Wu et al. ..... 345/102
2008/0179498 A1 * 7/2008 Shimizu ..... H05B 33/0851 250/214 AL
2009/0073343 A1 * 3/2009 Kojima et al. ..... 349/61
2009/0129048 A1 * 5/2009 Wang ..... G06F 3/0202 362/23.03
2009/0231313 A1 9/2009 Teranishi et al.
2009/0289965 A1 11/2009 Kurokawa et al.
2010/0020108 A1 * 1/2010 Cho ..... G09G 3/3406 345/690
2010/0060658 A1 3/2010 Fujii et al.
2011/0032008 A1 * 2/2011 Zhao ..... H03K 7/08 327/114
2011/0074301 A1 * 3/2011 Goder ..... H05B 33/0818 315/210
2012/0293404 A1 * 11/2012 Federico et al. ..... 345/156
2013/0049612 A1 * 2/2013 Yang et al. ..... 315/185 R
2013/0049637 A1 * 2/2013 Chen ..... H05B 33/0866 315/297
2013/0120480 A1 5/2013 Takada et al.

OTHER PUBLICATIONS

"Circuits today" Aug. 31, 2011, www.circuitstoday.com/band-pass-filters, Narrow band pass.*

* cited by examiner

*Primary Examiner* — Ilana Spar
*Assistant Examiner* — Mihir Rayan

(57) ABSTRACT

A brightness control apparatus and a brightness control method are provided. A conversion unit converts a first pulse width modulating signal, indicating brightness of a display, into a DC signal. An analog to digital conversion unit converts the DC signal into a second pulse width modulating signal according to at least one of an environmental condition and a load state of an electronic device, wherein the second pulse width modulating signal controls the brightness of the display.

9 Claims, 2 Drawing Sheets

BRIGHTNESS CONTROL APPARATUS AND BRIGHTNESS CONTROL METHOD

BACKGROUND OF THE INVENTION

1. Field of the Invention

The invention generally relates to a control apparatus and in particular relates to a brightness control apparatus and a brightness control method.

2. Description of Related Art

Computers may be categorized into two types, i.e. military computers and general computers. The difference between the military computer and the general computer is that the military computer usually needs to be operable in harsh environments, e.g. high temperature or low temperature. Thus, the requirements for military computer in terms of operability at various ambient temperatures are much stricter than general computer. Factors, such as slimness and light weight which are important to the general computer, but are not the main concern for military computer.

When the military computer operates in harsh environments such as high temperature or low temperature, the control of the brightness of a display thereof is necessary for the normal operation of the military computer. For example, at high temperature, the brightness of the display needs to be decreased so as to prevent the display from showing black screen. At low temperature, the brightness of the display needs to be decreased to avoid excessive power consumption (because starting-up takes longer time at low temperature and the work of other components needs adjustment for heating). In addition, in a heavy load state, the brightness of the display also needs to be reduced to lower the power consumption of the overall system.

Before Windows operating system Windows 8 is introduced, the brightness of the display is controlled by a pulse width modulating signal outputted by an embedded controller. Therefore, free adjustment of the brightness is possible. In the structure of Windows 8, however, the brightness of the display is controlled by Windows Display Driver Model (WDDM). In other words, the brightness of the display is controlled by the pulse width modulating signal outputted by a platform controller hub (PCH) under control of a driver of the Windows Display Driver Model. Thus, the traditional method for adjusting the brightness of the display to achieve normal operation of the computer at high temperature, low temperature, or heavy load is not applicable.

SUMMARY OF THE INVENTION

The invention provides a brightness control apparatus and a brightness control method capable of adjusting brightness of a display of an electronic device using Windows 8 operating system in a condition of high temperature, low temperature, or heavy load, so that the electronic device operates normally.

A brightness control apparatus of the invention is adapted to control brightness of a display of an electronic device. The brightness control apparatus includes a conversion unit and an analog to digital conversion unit. The conversion unit converts a first pulse width modulating signal into a DC signal, wherein the first pulse width modulating signal indicates the brightness of the display. The analog to digital conversion unit is coupled to the conversion unit and converts the DC signal into a second pulse width modulating signal according to at least one of an environmental condition and a load state of the electronic device. The second pulse width modulating signal controls the brightness of the display.

In an embodiment of the invention, the analog to digital conversion unit further generates a duty ratio according to at least one of the environmental condition and the load state of the electronic device, and converts the DC signal into the second pulse width modulating signal according to the duty ratio.

In an embodiment of the invention, the environmental condition includes an ambient temperature, and when the ambient temperature is higher than a first preset temperature or lower than a second preset temperature, the analog to digital conversion unit adjusts the duty ratio of the second pulse width modulating signal to adjust the brightness of the display to be lower than a preset low brightness.

In an embodiment of the invention, the environmental condition includes an ambient light intensity, and when the ambient light intensity is higher than a preset light intensity, the analog to digital conversion unit adjusts the duty ratio of the second pulse width modulating signal to adjust the brightness of the display to be higher than a preset high brightness.

In an embodiment of the invention, when the electronic device is in a heavy load state, the analog to digital conversion unit adjusts the duty ratio of the second pulse width modulating signal to adjust the brightness of the display to be lower than a preset low brightness.

In an embodiment of the invention, the conversion unit includes a band pass filter unit and a low pass filter unit. The band pass filter unit performs band pass filtering on the first pulse width modulating signal. The low pass filter unit is coupled to the band pass filter unit and the analog to digital conversion unit. The low pass filter unit performs low pass filtering on a signal of an output terminal of the band pass filter unit to generate the DC signal.

In an embodiment of the invention, the band pass filter unit includes an operational amplifier, a first resistor, a first capacitor, a second resistor and a second capacitor. A positive input terminal of the operational amplifier is coupled to a reference voltage. The first resistor is coupled to a negative input terminal of the operational amplifier. The first capacitor is coupled between the negative input terminal of the operational amplifier and a ground. The second capacitor and the second resistor are connected in parallel between the negative input terminal and an output terminal of the operational amplifier.

In an embodiment of the invention, the low pass filter unit includes a resistor and a capacitor. The resistor is coupled between the output terminal of the band pass filter unit and an output terminal of the low pass filter unit. The capacitor is coupled between the output terminal of the low pass filter unit and the ground.

A brightness control method of the invention is adapted for a display of an electronic device, and the brightness control method includes the following steps: converting a first pulse width modulating signal into a DC signal, wherein the first pulse width modulating signal indicates the brightness of the display; converting the DC signal into a second pulse width modulating signal according to at least one of an environmental condition and a load state of the electronic device, wherein the second pulse width modulating signal controls the brightness of the display.

In an embodiment of the invention, the step of converting the DC signal into the second pulse width modulating signal according to at least one of the environmental condition and the load state of the electronic device includes the following steps: generating a duty ratio according to at least one of the environmental condition and the load state of the electronic device; and converting the DC signal into the second pulse width modulating signal according to the duty ratio.

In an embodiment of the invention, the environmental condition includes an ambient temperature, and when the ambient temperature is higher than a first preset temperature or when the ambient temperature is lower than a second preset temperature, the duty ratio of the second pulse width modulating signal is adjusted to adjust the brightness of the display to be lower than a preset low brightness.

In an embodiment of the invention, the environmental condition includes an ambient light intensity, and when the ambient light intensity is higher than a preset light intensity, the duty ratio of the second pulse width modulating signal is adjusted to adjust the brightness of the display to be higher than a preset high brightness.

In an embodiment of the invention, when the electronic device is in a heavy load state, the duty ratio of the second pulse width modulating signal is adjusted to adjust the brightness of the display to be lower than a preset low brightness.

Based on the above, the invention converts the first pulse width modulating signal which indicates the brightness of the display into the DC signal by the conversion unit and converts the DC signal into the second pulse width modulating signal according to at least one of the environmental condition and the load state of the electronic device by the analog to digital conversion unit, thereby adjusting the brightness of the display according to the ambient temperature of the environment of the electronic device that uses Windows 8 operating system or according to the operation state of the electronic device, so that the electronic device operates normally.

In order to make the invention more comprehensible, the invention is further described in detail in the following with reference to the embodiments and the accompanying drawings.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
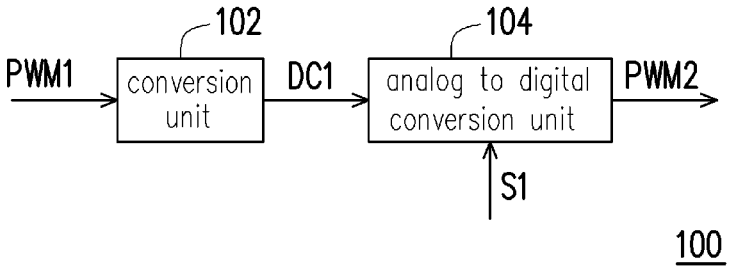
FIG. 1 is a schematic diagram of a brightness control apparatus according to an embodiment of the invention.

FIG. 1 is a schematic diagram illustrating a brightness control apparatus according to an embodiment of the invention. Please refer to FIG. 1. The brightness control apparatus 100 includes a conversion unit 102 and an analog to digital conversion unit 104. The conversion unit 102 is coupled to the analog to digital conversion unit 104. The brightness control apparatus 100 is adapted to control the brightness of a display of an electronic device. The electronic device may be, for example, a notebook computer, a desktop computer, etc. The conversion unit 102 converts a pulse width modulating signal PWM1 (e.g. a pulse width modulating signal from a platform controller hub) into a DC signal DC1, wherein the pulse width modulating signal PWM1 indicates the brightness which the platform controller hub wants the display to display. The analog to digital conversion unit 104 converts the DC signal into a pulse width modulating signal PWM2 according to at least one of an environmental condition and a load state of the electronic device, wherein the pulse width modulating signal PWM2 is for controlling the brightness of the display. The analog to digital conversion unit 104 may be implemented, for example, by a keyboard controller (KBC). However, the invention is not limited thereto.

Figure 2:
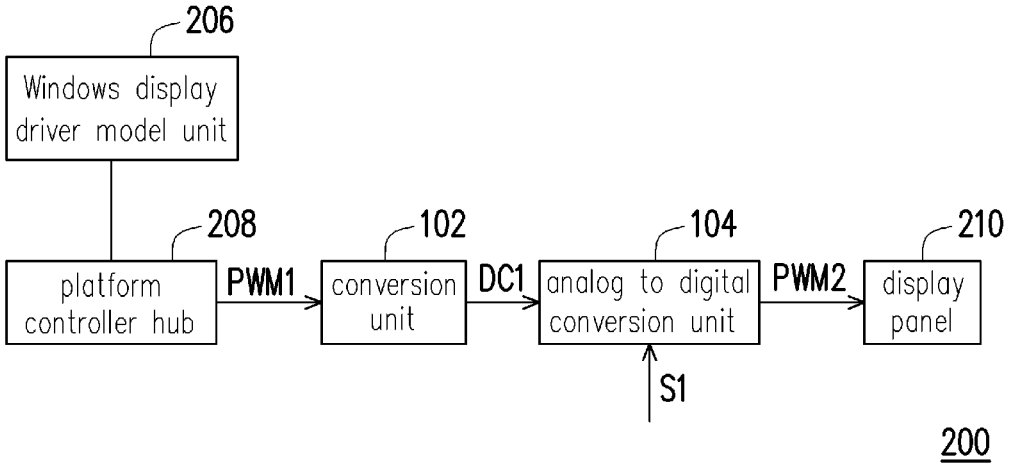
FIG. 2 is a schematic diagram of a brightness control apparatus according to another embodiment of the invention.

FIG. 2 is a schematic diagram of a brightness control apparatus according to another embodiment of the invention. Please refer to FIG. 2. In comparison with the brightness control apparatus 100, a brightness control apparatus 200 in this embodiment further includes a windows display driver model (WDDM) unit 206, a platform controller hub (PCH) 208, and a display panel 210. The platform controller hub 208 is coupled to the windows display driver model unit 206 and the conversion unit 102. The analog to digital conversion unit 104 is further coupled to the display panel 210. The windows display driver model unit 206 controls the platform controller hub 208 to output the pulse width modulating signal PWM1 for brightness control. The conversion unit 102 receives the pulse width modulating signal PWM1 from the platform controller hub 208 and converts the pulse width modulating signal PWM1 into the DC signal DC1, wherein the pulse width modulating signal PWM1 indicates the brightness which the platform controller hub 208 wants the display to display, i.e. the brightness of the display panel 210. The analog to digital conversion unit 104 converts the DC signal into the pulse width modulating signal PWM2 according to at least one of the environmental condition and the load state of the electronic device, wherein the pulse width modulating signal PWM2 is for controlling the brightness of the display panel 210.

Specifically, the environmental condition may be an ambient temperature or an ambient light intensity of the electronic device, for example. The environmental condition may be detected by equipment, such as a temperature sensor (not shown), a light sensor (not shown), and on the like. Then, a detecting result S1 is transmitted to the analog to digital conversion unit 104 so that the analog to digital conversion unit 104 determines how to output the pulse width modulating signal PWM2 according to the detecting result S1. When the environmental condition is less harsh (e.g. when the ambient temperature of the environment of the electronic device is in a range of normal temperature and the ambient light intensity is not strong), the analog to digital conversion unit 104 may output the pulse width modulating signal PWM2 according to the DC signal DC1. The DC signal DC1 is obtained through conversion of the pulse width modulating signal PWM1. Thus, a duty ratio of the pulse width modulating signal PWM1 is reflected by a level of the DC signal DC1, and through the analog to digital conversion unit 104, the DC signal DC1 is further converted into the pulse width modulating signal PWM2 having the same duty ratio as the pulse width modulating signal PWM1. That is to say, when the environmental condition is less harsh, the analog to digital conversion unit 104 may generate the pulse width modulating signal PWM2 according to the duty ratio of the pulse width modulating signal PWM1, so that the brightness of the display conforms to the brightness which the platform controller hub wants the display to display.

On the contrary, if the environmental condition is harsher (i.e. the ambient temperature of the electronic device is not in the range of normal temperature or the ambient light intensity is too strong for the user using the electronic device to clearly recognize the content displayed by the display), the analog to digital conversion unit 104 may not generate the pulse width modulating signal PWM2 according to the DC signal DC1, but instead generate the pulse width modulating signal PWM2 with duty ratio different from the pulse width modulating signal PWM1 according to the environmental condition, that is, to adjust the brightness of the display to a display brightness suitable for the current environmental condition according to the detecting result S1.

To be specific, the analog to digital conversion unit 104 may receive the detecting result S1 of the temperature sensor and thereby determine and adjust the pulse width modulating signal PWM2. For example, the analog to digital conversion unit 104 may determine whether the ambient temperature is higher than a first preset temperature or lower than a second preset temperature, wherein the first preset temperature is higher than the second preset temperature. If the ambient temperature is higher than the first preset temperature or lower than the second preset temperature, namely, the ambient temperature is too high or too low and is out of the range of normal temperature, the analog to digital conversion unit 104 generates the duty ratio of the pulse width modulating signal PWM2 according to the ambient temperature, so as to adjust the brightness of the display to be lower than a preset low brightness. Therefore, problems, such as a black screen of the display of the electronic device that occurs at high temperature or excessive power consumption that occurs at low temperature, which influence a normal operation or normal starting up of the electronic device, are prevented.

In addition, the analog to digital conversion unit 104 may also receive the detecting result S1 of the light sensor and determine whether the ambient light intensity is higher than a preset light intensity according to the detecting result S1 of the light sensor. If the ambient light intensity is higher than the preset light intensity and causes that the user is unable to recognize clearly the content displayed by the display, the analog to digital conversion unit 104 adjusts the duty ratio of the pulse width modulating signal PWM2, so as to adjust the brightness of the display to be higher than a preset high brightness, for overcoming the issue that the ambient light intensity affects the user's watching of the content displayed by the display.

In addition, the analog to digital conversion unit 104 may also determine whether the electronic device is in a heavy load state or not. If the electronic device is in the heavy load state, the analog to digital conversion unit 104 may adjust the duty ratio of the pulse width modulating signal PWM2, so as to adjust the brightness of the display to be lower than a preset low brightness, for decreasing the power consumption of the electronic device and extending the work time of the electronic device.

It should be noticed that the preset high brightness and the preset low brightness respectively refer to an upper limit value and a lower limit value, between which the platform controller hub may adjust the brightness of the display under control of Windows Display Driver Model. To make the electronic device conform with military requirements or other special requirements, the analog to digital conversion unit 104 may not adjust the brightness of the display according to the duty ratio of the pulse width modulating signal PWM1 outputted from the platform controller hub 208. Instead, the analog to digital conversion unit 104 may adjust the brightness of the display to be higher than the preset high brightness or lower than the preset low brightness in accordance with the pulse width modulating signal PWM2 according to at least one of the environmental condition and the load state of the electronic device, such that the electronic device operates normally in harsh environmental conditions.

Figure 3:
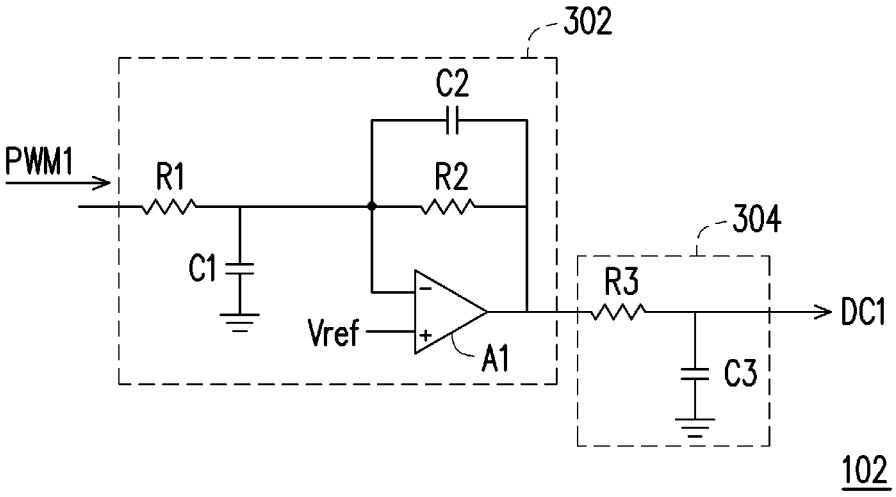
FIG. 3 is a schematic diagram of a conversion unit according to an embodiment of the invention.

FIG. 3 is a schematic diagram of a conversion unit according to an embodiment of the invention. Please refer to FIG. 3. To be specific, the conversion unit 102 in FIG. 2 may be embodied as shown in FIG. 3. The conversion unit 102 includes a band pass filter unit 302 and a low pass filter unit 304, wherein the low pass filter unit 304 is coupled to the band pass filter unit 302 and the analog to digital conversion unit 104. To be specific, the band pass filter unit 302 and the low pass filter unit 304 may be embodied as shown in FIG. 3. The band pass filter unit 302 includes a resistor R1, a resistor R2, a capacitor C1, a capacitor C2, and an operational amplifier A1. The low pass filter unit 304 includes a resistor R3 and a capacitor C3. The resistor R2 and the capacitor C2 are connected in parallel between a negative input terminal and an output terminal of the operational amplifier A1. A terminal of the resistor R1 is coupled to the negative input terminal of the operational amplifier A1, and another terminal of the resistor R1 receives the pulse width modulating signal PWM1. The capacitor C1 is coupled between the negative input terminal of the operational amplifier A1 and a ground. A positive input terminal of the operational amplifier A1 is coupled to a reference voltage Vref. Moreover, the resistor R3 is coupled between the output terminal of the operational amplifier A1 and the analog to digital conversion unit 104. The capacitor C3 is coupled between the output terminal of the operational amplifier A1 and the ground.

As shown in FIG. 3, the pulse width modulating signal PWM1 is inputted to one terminal of the resistor R1 of the band pass filter unit 302, for the band pass filter unit 302 including the resistors R1, R2, the capacitors C1, C2, and the operational amplifier A1 to perform band pass filtering. Then, a signal after the band pass filtering is outputted to the low pass filter unit 304 to for low pass filtering, thereby generating the DC signal DC1 to be outputted to the analog to digital conversion unit 104.

Figure 4:
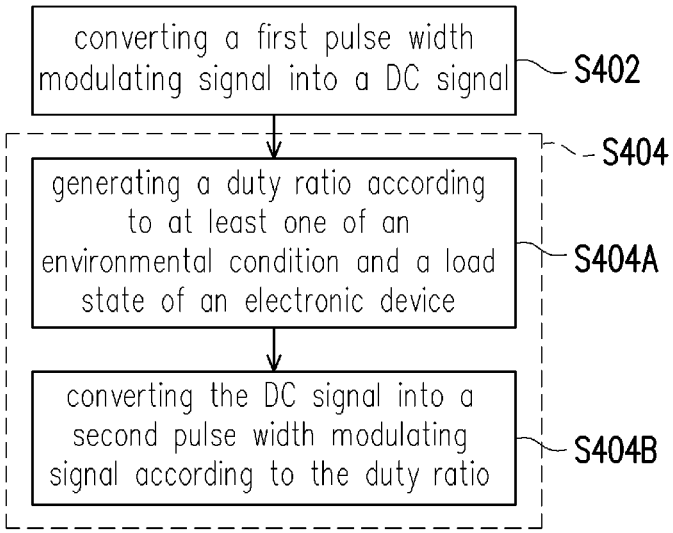
FIG. 4 is a schematic flow chart of a brightness control method according to an embodiment of the invention.

FIG. 4 is a schematic flow chart of a brightness control method according to an embodiment of the invention. Please refer to FIG. 4. The brightness control method of the aforementioned brightness control apparatus may include the following steps. First, the first pulse width modulating signal is converted into the DC signal (step S402), wherein the first pulse width modulating signal indicates the brightness which the platform controller hub wants the display to display. Next, the DC signal is converted into the second pulse width modulating signal according to at least one of the environmental condition and the load state of the electronic device (step S404), wherein the second pulse width modulating signal controls the brightness of the display. To be specific, step S404 may include generating a duty ratio according to at least one of the environmental condition and the load state of the electronic device (step S404A), and then converting the DC signal into the second pulse width modulating signal according to the duty ratio (step S404B), wherein the environmental condition includes the ambient temperature and the ambient light intensity.

Furthermore, a method of adjusting the duty ratio of the second pulse width modulating signal according to the environmental condition is as follows, for example. When the ambient temperature is higher than the first preset temperature or when the ambient temperature is lower than the second preset temperature, the duty ratio of the second pulse width modulating signal is adjusted to adjust the brightness of the display to be lower than the preset low brightness. Alternatively, when the ambient light intensity is higher than the preset light intensity, the duty ratio of the second pulse width modulating signal is adjusted for adjusting the brightness of the display to be higher than the preset high brightness. In addition, a method of adjusting the duty ratio of the second pulse width modulating signal according to the load state of the electronic device is as follows, for example. When the electronic device is in the heavy load state, the duty ratio of the second pulse width modulating signal is adjusted to adjust the brightness of the display to be lower than the preset low brightness.

To sum up, in an embodiment of the invention, the conversion unit converts the first pulse width modulating signal which indicates the brightness of the display into the DC signal, and the analog to digital conversion unit converts the DC signal into the second pulse width modulating signal according to at least one of the environmental condition and the load state of the electronic device, thereby adjusting the brightness of the display according to the ambient temperature or the ambient light intensity of the electronic device that uses Windows 8 operating system, or according to the operation state of the electronic device, so that the electronic device operates normally.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A brightness control apparatus adapted to control brightness of a display of an electronic device, and the brightness control apparatus comprising:

a conversion unit converting a first pulse width modulating signal into a DC signal, wherein the first pulse width modulating signal indicates the brightness of the display; and an analog to digital conversion unit coupled to the conversion unit and converting the DC signal into a second pulse width modulating signal according to an environmental condition and a load state of the electronic device, wherein the second pulse width modulating signal controls the brightness of the display;

wherein the analog to digital conversion unit further generates a duty ratio according to the environmental condition and the load state of the electronic device, and converts the DC signal into the second pulse width modulating signal according to the duty ratio; and wherein when the electronic device is in a heavy load state, the analog to digital conversion unit adjusts the duty ratio of the second pulse width modulating signal to adjust the brightness of the display to be lower than a preset low brightness.

2. The brightness control apparatus as claimed in claim 1, wherein the environmental condition comprises an ambient temperature, and when the ambient temperature is higher than a first preset temperature or lower than a second preset temperature, the analog to digital conversion unit adjusts the duty ratio of the second pulse width modulating signal to adjust the brightness of the display to be lower than a preset low brightness.

3. The brightness control apparatus as claimed in claim 1, wherein the environmental condition comprises an ambient light intensity, and when the ambient light intensity is higher than a preset light intensity, the analog to digital conversion unit adjusts the duty ratio of the second pulse width modulating signal to adjust the brightness of the display to be higher than a preset high brightness.

4. The brightness control apparatus as claimed in claim 1, wherein the conversion unit comprises:

a band pass filter unit performing band pass filtering on the first pulse width modulating signal; and a low pass filter unit coupled to the band pass filter unit and the analog to digital conversion unit, and performing low pass filtering on a signal of an output terminal of the band pass filter unit to generate the DC signal.

5. The brightness control apparatus as claimed in claim 4, wherein the band pass filter unit comprises:

an operational amplifier, having a positive input terminal coupled to a reference voltage;

a first resistor coupled to a negative input terminal of the operational amplifier;

a first capacitor, coupled between the negative input terminal of the operational amplifier and a ground;

a second resistor; and a second capacitor, connected in parallel with the second resistor between the negative input terminal and an output terminal of the operational amplifier.

6. The brightness control apparatus as claimed in claim 4, wherein the low pass filter unit comprises:

a resistor, coupled between the output terminal of the band pass filter unit and an output terminal of the low pass filter unit; and a capacitor, coupled between the output terminal of the low pass filter unit and the ground.

7. A brightness control method adapted for a display of an electronic device, the brightness control method comprising:

converting a first pulse width modulating signal into a DC signal, wherein the first pulse width modulating signal indicates brightness of the display; and converting the DC signal into a second pulse width modulating signal according to an environmental condition and a load state of the electronic device, wherein the second pulse width modulating signal controls the brightness of the display wherein the step of converting the DC signal into the second pulse width modulating signal according to at least one of the environmental condition and the load state of the electronic device comprises:

generating a duty ratio according to the environmental condition and the load state of the electronic device; and converting the DC signal into the second pulse width modulating signal according to the duty ratio; and wherein when the electronic device is in a heavy load state, the duty ratio of the second pulse width modulating signal is adjusted to adjust the brightness of the display to be lower than a preset low brightness.

8. The brightness control method as claimed in claim 7, wherein the environmental condition comprises an ambient temperature, and when the ambient temperature is higher than a first preset temperature or lower than a second preset temperature, the duty ratio of the second pulse width modulating signal is adjusted to adjust the brightness of the display to be lower than a preset low brightness.

9. The brightness control method as claimed in claim 7, wherein the environmental condition comprises an ambient light intensity, and when the ambient light intensity is higher than a preset light intensity, the duty ratio of the second pulse width modulating signal is adjusted to adjust the brightness of the display to be higher than a preset high brightness.

* * * * *